US011498595B2

(12) United States Patent
Hankinson et al.

(10) Patent No.: US 11,498,595 B2
(45) Date of Patent: Nov. 15, 2022

(54) TELESCOPING UNCOUPLING LEVER ASSEMBLY

(71) Applicant: Transportation IP Holdings, LLC, Norwalk, CT (US)

(72) Inventors: Stephen Hankinson, Mars, PA (US); Walter J. Peach, Montgomery, IL (US); John D. Anderson, Oswego, IL (US)

(73) Assignee: Transportation IP Holdings, LLC, Norwalk, CT (US)

( * ) Notice: Subject to any disclaimer, the term of this patent is extended or adjusted under 35 U.S.C. 154(b) by 364 days.

(21) Appl. No.: 16/692,645

(22) Filed: Nov. 22, 2019

(65) Prior Publication Data

US 2020/0172127 A1 Jun. 4, 2020

Related U.S. Application Data

(60) Provisional application No. 62/775,061, filed on Dec. 4, 2018.

(51) Int. Cl.

| | |
|---|---|
| ***B61G 3/08*** | (2006.01) |
| ***B61G 7/02*** | (2006.01) |
| *B61G 9/20* | (2006.01) |
| *B61G 7/04* | (2006.01) |
| *B61G 7/14* | (2006.01) |
| *B61G 7/10* | (2006.01) |

(52) U.S. Cl.

CPC ..... *B61G 3/08* (2013.01); *B61G 7/02* (2013.01); *B61G 7/04* (2013.01); *B61G 7/10* (2013.01); *B61G 7/14* (2013.01); *B61G 9/20* (2013.01)

(58) Field of Classification Search

CPC ... B61G 3/08; B61G 7/02; B61G 7/04; B61G 7/10; B61G 7/14; B61G 9/20

See application file for complete search history.

(56) References Cited

U.S. PATENT DOCUMENTS

| | | | | |
|---|---|---|---|---|
| 3,409,146 | A | 11/1968 | Taylor | |
| 3,598,250 | A | 8/1971 | Terlecky et al. | |
| 3,735,878 | A | 5/1973 | Allen | |
| 3,762,575 | A | 10/1973 | Cseri | |
| 3,814,267 | A | 6/1974 | Chierici | |
| 4,010,854 | A | 3/1977 | Manyek | |
| 4,602,717 | A | 7/1986 | Krzanowsky | |
| 6,739,464 | B1 | 5/2004 | Manyek | |
| 7,686,177 | B1 | 3/2010 | Jackson | |
| 7,900,786 | B2 | 3/2011 | Hepburn | |
| 10,017,194 | B1 * | 7/2018 | Jackson | B61G 7/02 |

OTHER PUBLICATIONS

"Telescoping Uncoupling Device Replacement Guide", Jackson International, available prior to Dec. 4, 2018 (1 page).

* cited by examiner

*Primary Examiner* — Robert J McCarry, Jr.
(74) *Attorney, Agent, or Firm* — McCoy Russell LLP

(57) ABSTRACT

A telescoping uncoupling lever assembly including a first lever, a hook connected to the first lever, a second lever, a handle connected to the second lever, and a third lever including a plurality of first lever connectors, a plurality of first glides bonded to the respective interior surfaces of the first lever connectors for engagement with the first lever, a plurality of second lever connectors, and a plurality of second glides bonded to the respective interior surfaces of the second lever connectors for engagement with the second lever.

27 Claims, 12 Drawing Sheets

TELESCOPING UNCOUPLING LEVER ASSEMBLY

PRIORITY

This application claims priority to and the benefit of U.S. Provisional Patent Application No. 62/775,061, filed Dec. 4, 2018, the entire contents of which are incorporated herein by reference.

BACKGROUND

Various vehicles (such as certain railroad cars) include an elongated frame, a car body mounted on the frame, and two spaced apart trucks that support the frame. These vehicles include coupler assemblies respectively mounted at and to opposite ends of the frame for respective connections to adjacent vehicles (such as railroad cars). Each coupler assembly includes, among other components, a coupler and a knuckle pivotally connected to the coupler by a knuckle pin. The knuckle pin pivotally connects the knuckle to the coupler. During the coupling process, when two respective coupler assemblies of adjacent vehicles are connected, the respective adjacent knuckles of the respective adjacent vehicles snap closed. Each coupler assembly further includes a lock lifter that facilitates disconnection of the respective knuckles and thus disconnection of the respective connected coupler assemblies of the adjacent vehicles.

Various vehicles also include telescoping uncoupling lever assemblies at each respective end of the vehicles. Each uncoupling lever assembly is pivotally connected at one end to the frame of the vehicle and at the opposite end to the lock lifter. The uncoupling lever assembly is configured to rotate the lock lifter of the coupler assembly to open the coupler to facilitate release from the corresponding coupler of the adjacent vehicle. More specifically, the uncoupling lever assembly includes a handle, and is configured such that rotating the handle causes the uncoupling lever assembly to rotate the lock lifter. Rotating the lock lifter causes the coupler to release or open so that the coupler assembly can be disconnected from the coupler assembly of the adjacent vehicle.

Coupler assemblies often move laterally relative to the frame of the vehicle when the vehicle negotiates a turn. Coupler assemblies also extend or retract upon impact with other vehicles. As the coupler assembly moves relative to the vehicle, the distance between the coupler assembly and the mounting location of the handle of the uncoupling lever assembly changes. Certain known uncoupling lever assemblies are configured to be able to change their lengths (i.e., are telescoping) to accommodate these movements of the coupler assembly relative to the frame of the vehicle. It is important that the levers of the uncoupling lever assembly remain freely movable relative to each other without binding. Any significant binding of the levers of the uncoupling lever assembly can prevent the uncoupling lever assembly from changing its length, which could result in damage to the vehicle, damage to the coupler assembly, and/or damage to the uncoupling lever assembly.

There are several known uncoupling lever assemblies that change their lengths. Many of these uncoupling lever assemblies include removable plastic glides that prevent metal-to-metal contact and such binding. However, over time, the removable plastic glides can be degraded by ultraviolet (UV) light and other environmental conditions. Additionally, over time, the removable plastic glides can be worn out or otherwise damaged due to the various substantial engagements of and forces encountered by the glides. If the plastic glides become damaged brittle due to UV light exposure or other conditions or forces, they may become cracked, fall out of position in the uncoupling lever assembly, and allow undesired metal-to-metal contact between the respective levers of the uncoupling lever assembly.

Another issue with certain known uncoupling lever assemblies is the individual levers can become disconnected and fall from the vehicle if certain relatively high opposing pulling forces are developed within the levers. Many existing uncoupling lever assemblies include stop structures that can restrict extension of the uncoupling lever assembly. If a stop structure fails due to certain relatively high opposing pulling forces applied to the stop structure, there is no mechanism to keep the three piece assembly together and the assembly can fall apart.

Accordingly, there is a continuing demand to improve various components of vehicles including uncoupling lever assemblies.

SUMMARY

Various embodiments of the present disclosure provide new vehicle telescoping uncoupling lever assemblies and new vehicles (such as but not limited to railroad cars) with such new telescoping uncoupling lever assemblies.

In various embodiments, the telescoping uncoupling lever assembly of the present disclosure includes: (1) a first lever including a first elongated member and a first stop connected to the first elongated member; (2) a second lever including a second elongated member and a second stop connected to the second elongated member; (3) a third lever including a third elongated member; (4) a hook connected to the first lever; and (5) a handle connected to the second lever. The third lever assembly further includes: (1) a plurality of first lever connectors; (2) a plurality of second lever connectors; (3) a plurality of first glides bonded to certain interior surfaces of the first lever connectors for engagement with the first lever; (4) a plurality of second glides bonded to certain interior surfaces of the second lever connectors for engagement with the second lever; (5) a plurality of third glides bonded to an exterior first side surface of the third lever for engagement with the first lever; and (6) a plurality of fourth glides bonded to an exterior second side surface of the third lever for engagement with the second lever. The glides are longitudinally shorter than the respective lever connectors. The first lever is slidably received within the first lever connectors and more specifically within the corresponding first and third glides. The second lever is slidably received within the second lever connectors and more specifically the corresponding second and fourth glides. The first and second levers are thus both independently slidable relative to the third lever. The first stop limits the movement of the first lever relative to the third lever. The second stop limits the movement of the second lever relative to the third lever.

Other objects, features, and advantages of the present disclosure will be apparent from the following detailed disclosure, taken in conjunction with the accompanying sheets of drawings, wherein like reference numerals refer to like parts.

DETAILED DESCRIPTION

Figure 1:
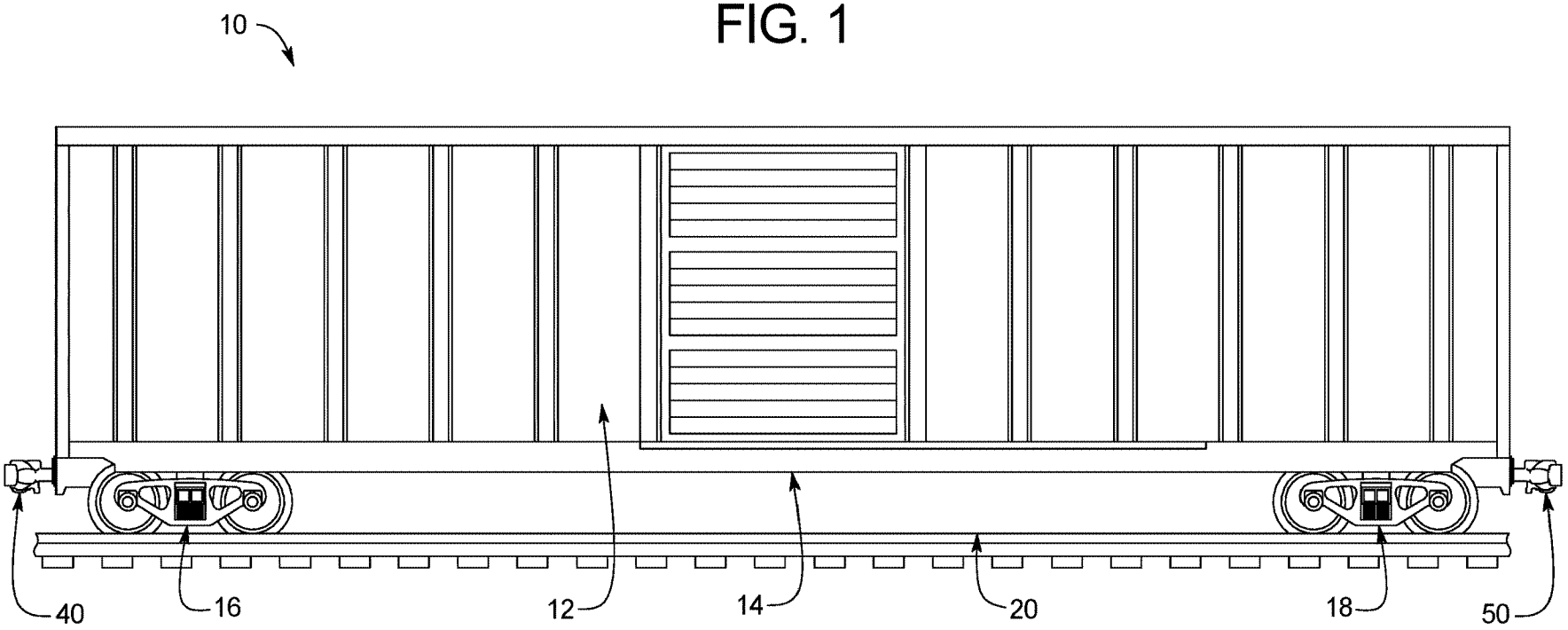
FIG. 1 is a side view of an example vehicle and particularly a freight railroad car positioned on railroad tracks.

While the systems, devices, and methods described herein may be embodied in various forms, the drawings show and the specification describes certain exemplary and non-limiting embodiments. Not all of the components shown in the drawings and described in the specification may be required, and certain implementations may include additional, different, or fewer components. Variations in the arrangement and type of the components; the shapes, sizes, and materials of the components; and the manners of connections of the components may be made without departing from the spirit or scope of the claims. Unless otherwise indicated, any directions referred to in the specification reflect the orientations of the components shown in the corresponding drawings and do not limit the scope of the present disclosure. Further, terms that refer to mounting methods, such as mounted, connected, etc., are not intended to be limited to direct mounting methods but should be interpreted broadly to include indirect and operably mounted, connected and like mounting methods. This specification is intended to be taken as a whole and interpreted in accordance with the principles of the present disclosure and as understood by one of ordinary skill in the art.

Figure 2:
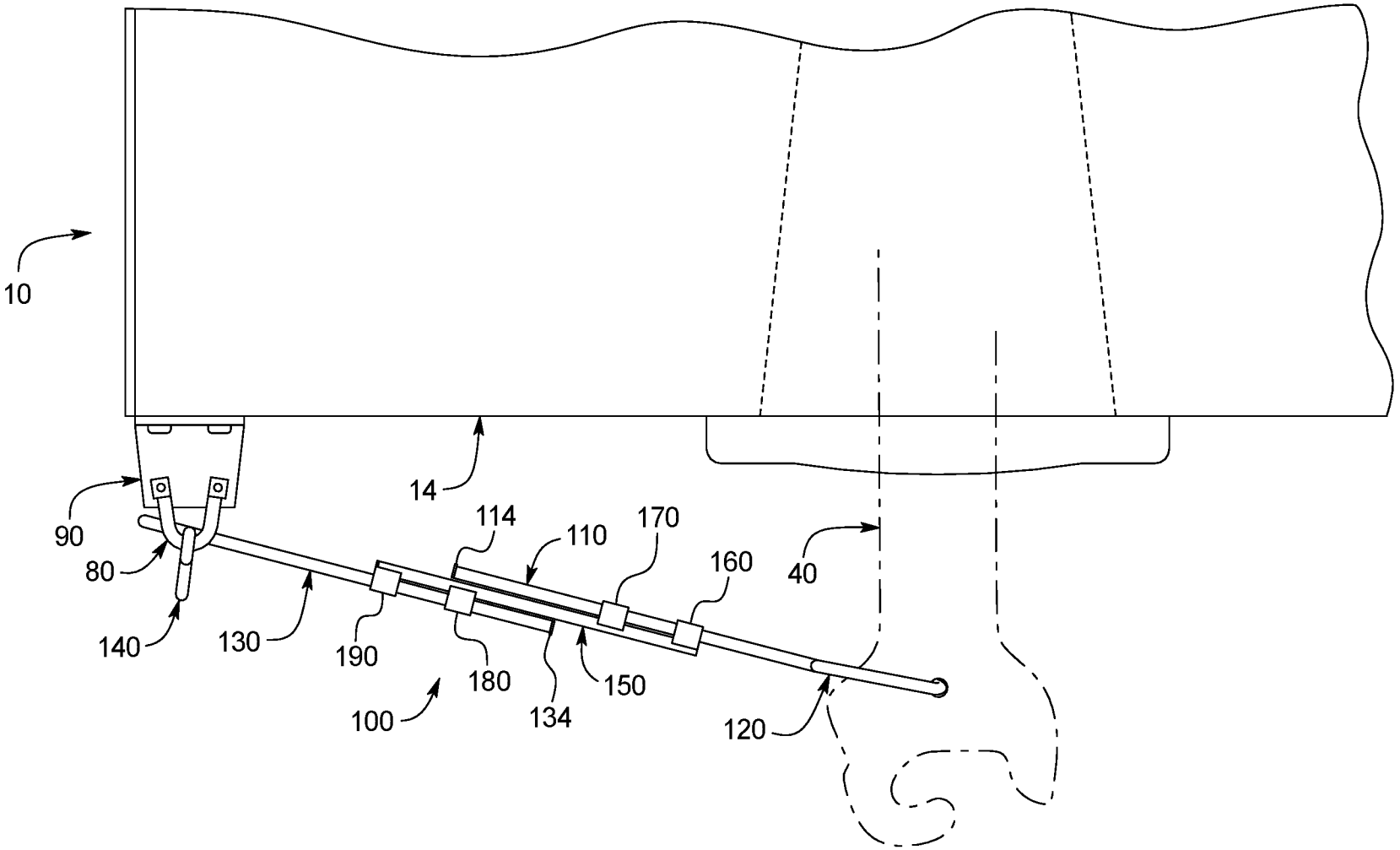
FIG. 2 is a diagrammatic fragmentary top view of the example vehicle and particularly a freight railroad car generally illustrating one of the coupler assemblies of the freight railroad car of FIG. 1, and a top view of an uncoupling lever assembly of one example embodiment of the present disclosure, connected at one end to the coupler assembly of the freight railroad car and connected at the opposite end to the frame, and specifically to a clevis and bracket connected to the frame of the freight railroad car.
Figure 3:
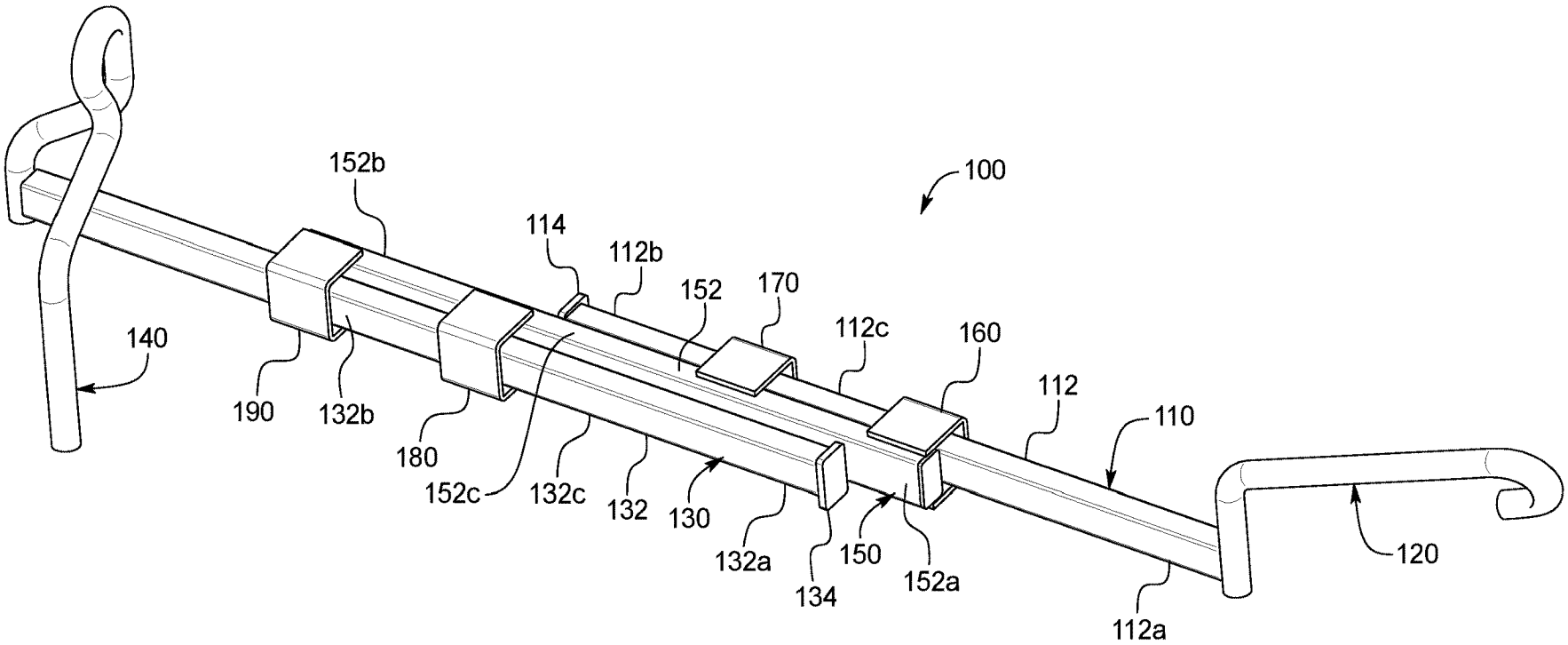
FIG. 3 is an enlarged top front perspective view of the uncoupling lever assembly of FIG. 2.
Figure 4:
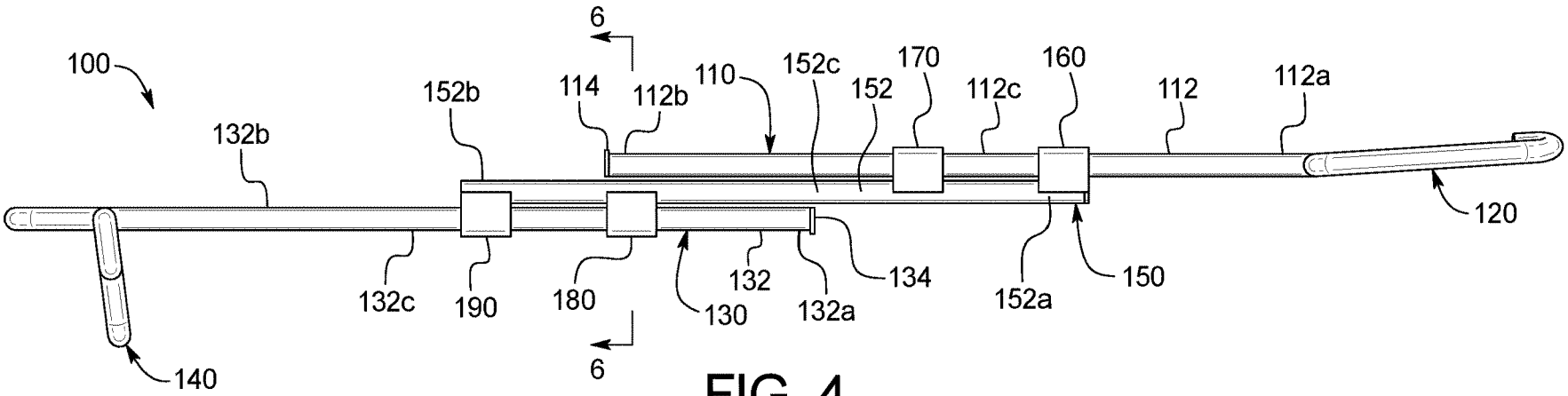
FIG. 4 is an enlarged top view of the uncoupling lever assembly of FIG. 2.
Figure 5:
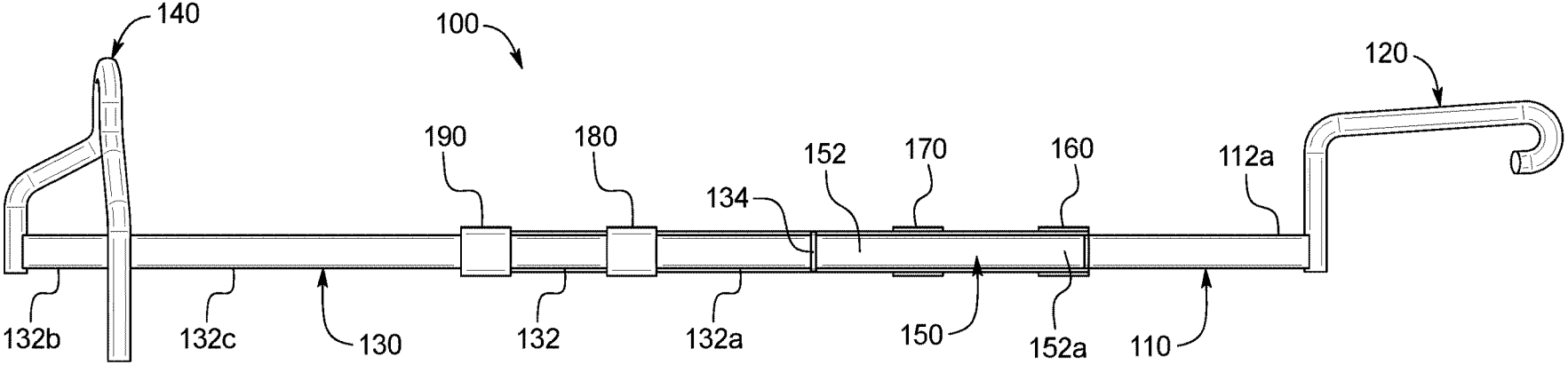
FIG. 5 is an enlarged front side view of the uncoupling lever assembly of FIG. 2.

Referring now to the drawings, FIGS. 1 and 2 generally illustrate an example vehicle and particularly a freight railroad car indicated by numeral 10. Uncoupling lever assemblies of the present disclosure can be employed in any suitable vehicle such as any railroad car including this example freight railroad car 10. It should be appreciated that the present disclosure is not limit to railroad cars or uncoupling lever assemblies for railroad cars.

This example railroad car 10 generally includes a car body 12 mounted on a frame 14, a first truck 16, and a second truck 18. The railroad car 10 is configured to roll along the tracks 20 via the first truck 16 and the second truck 18 in a conventional manner. The car body 12 and the frame 14 rotatably rests on the first truck 16 and the second truck 18 in a conventional manner to navigate curves (not shown) in the tracks 20. The railroad car 10 includes first and second coupler assemblies 40 and 50 at opposite ends of the car body 12. Each coupler assembly is configured to facilitate connection of the railroad car 10 to an adjacent railroad car (not shown). The various components of the railroad car and the coupler assemblies that are not shown can be conventional or new components (as will be appreciated by one of ordinary skill in the art) and will thus not be described herein.

FIGS. 2 to 7 generally illustrate one example embodiment of a coupler assembly 40 and a telescoping uncoupling lever assembly of one example embodiment of the present disclosure, generally indicated by numeral 100. In this illustrated example embodiment, the example uncoupling lever assembly 100 is configured to pivotally connect to a lock lifter (not shown) of the coupler assembly 40 and to a clevis 80 connected to a bracket 90 which in turn is connected to the frame 14 of the railroad car 10.

In this illustrated example embodiment, the uncoupling lever assembly 100 includes: (1) a first lever 110; (2) a hook 120 connected to the first lever 110; (3) a second lever 130; (4) a handle 140 connected to the second lever 130; and (5) a third lever 150 slidably connected to the first lever 110 and the second lever 130, and slidably connecting the first lever 110 and the second lever 130.

Figure 6:
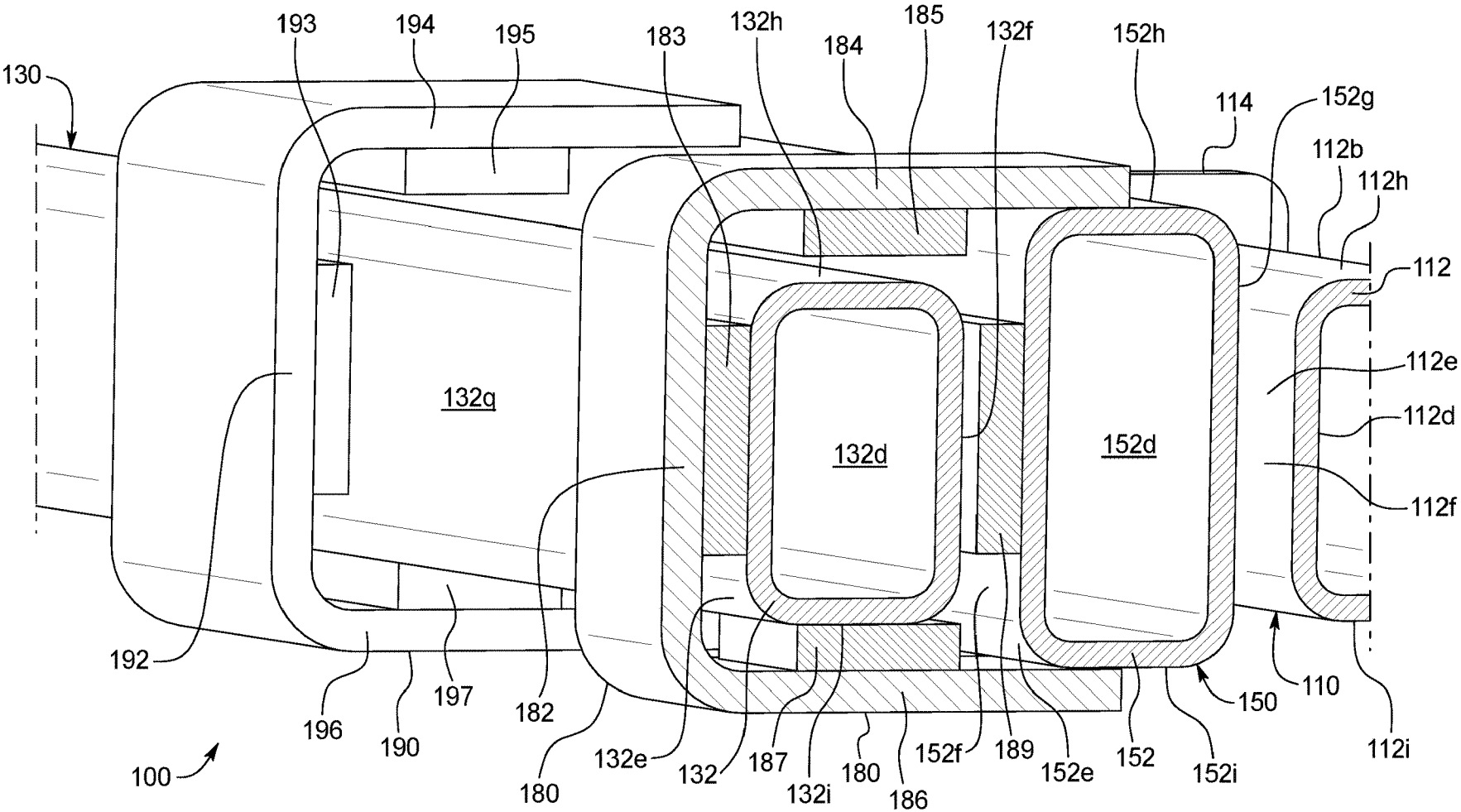
FIG. 6 is a further enlarged fragmentary vertical cross sectional view of part of the uncoupling lever assembly of FIG. 2.
Figure 7:
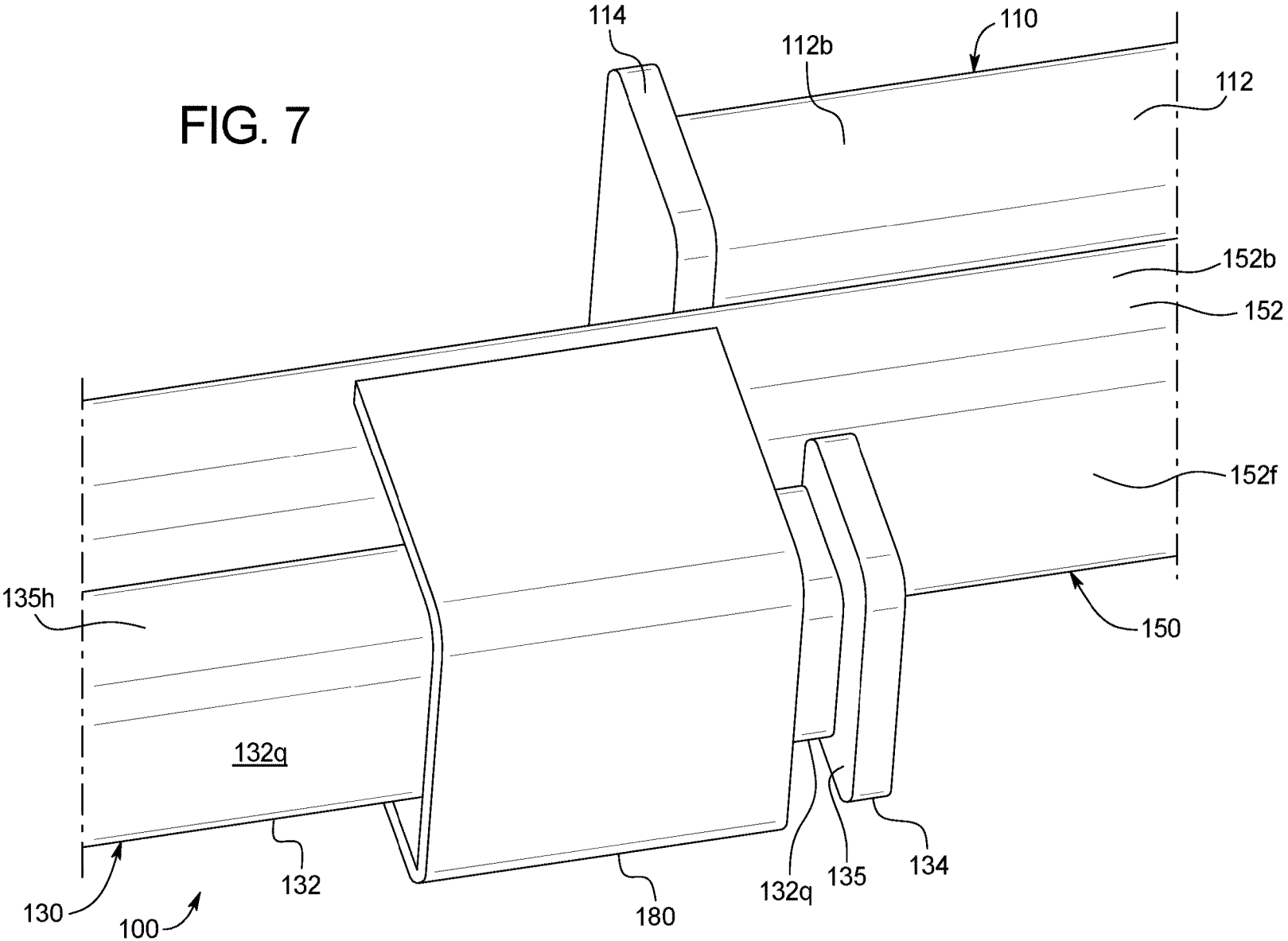
FIG. 7 is an enlarged fragmentary perspective view of part of the uncoupling lever assembly of FIG. 2, showing the first stop of the first lever connected to the end of the elongated member of the first lever, and showing the stop of the second lever connected to the end of the elongated member of the second lever.

The first lever 110 includes an elongated member such as the elongated rectangular tube or tubular member 112 having: (1) a first end 112*a*; (3) a second end 112*b* opposite the first end 112*a*; and (3) an intermediate portion 112*c* extending between the first end 112*a* and the second end 112*b*. As best shown in FIG. 6, the elongated rectangular tube 112 includes an interior surface 112*d* and an exterior surface 112*e*. The exterior surface 112*e* includes a first side surface 112*f*, a second side surface 112*g* (not labeled in drawings), a top surface 112*h*, and a bottom surface 112*i*.

The first lever 110 includes a stop 114 suitably integrally fixedly connected to the second end 112*b* of the elongated tube 112. The stop 114 is configured to engage the outer end edges (not labeled) of the connector 170 to prevent the tube 112 from sliding out of the connectors 170 and 160. The stop 114 has a greater width than the tube 112 and a greater height than the tube 112. More specifically, in this illustrated example embodiment, the stop 114 includes a first lip (not labeled) that extends above the tube 112, a second lip (not labeled) that extends below the tube 112, and a third lip (not labeled) that extends outwardly from the tube 112. These three lips co-act to provide a significant engagement area with the side edges of the connector 170 to suitably spread out the force that occurs when the stop 114 engages the connector 170 such that the stop 114 and the connector 170 are less likely to break. This reduces the chance that the first lever 110 will become disconnected from the third lever 150.

It should be appreciated that in other embodiments of the present disclosure, the stop 114 can include a first lip that extends above the tube 112 and a second lip that extends outwardly from the tube 112 (but not a lip that extends downwardly from the tube 112). It should be appreciated that in other embodiments of the present disclosure, the stop 114 can include a first lip that extends below the tube 112 and a second lip that extends outwardly from the tube 112 (but not a lip that extends upwardly from the tube 112). It should be appreciated that in other embodiments of the present disclosure, the stop 114 can include a first lip that extends above the tube 112 and a second lip that extends downwardly from the tube 112 (but not a lip that extends outwardly from the tube 112).

The second lever 130 includes an elongated member such as the elongated rectangular tube or tubular member 132 having: (1) a first end 132*a*; (3) a second end 132*b* opposite the first end 132*a*; and (3) an intermediate portion 132*c* extending between the first end 132*a* and the second end 132*b*. As best shown in FIG. 6, the elongated rectangular tube 132 includes an interior surface 132*d* and an exterior surface 132*e*. The exterior surface 132*e* includes a first side surface 132*f*, a second side surface 132*g*, a top surface 132*h*, and a bottom surface 132*i*.

The second lever 130 includes a stop 134 suitably integrally fixedly connected to the first end 132*a* of the elongated tube 132. The stop 134 is configured to engage the outer end edges (not labeled) of the connector 180 to prevent the tube 132 from sliding out of the connectors 180 and 190. The stop 134 has a greater width than the tube 132 and a greater height than the tube 132. More specifically, the stop 134 includes a first lip (not labeled) that extends above the tube 132, a second lip (not labeled) that extends outwardly from the tube 132, and a third lip (not labeled) that extends below the tube 132. These three lips co-act to provide a significant engagement area with the side edges of the connector 180 to suitably spread out the force that occurs when the stop 134 engages the connector 180 such that the stop 134 and the connector 180 are less likely to break. It should be appreciated that in other embodiments of the present disclosure, the stop 134 can include a first lip that extends above the tube 132 and a second lip that extends outwardly from the tube 132 (but not a lip that extends downwardly from the tube 132). It should be appreciated that in other embodiments of the present disclosure, the stop 134 can include a first lip that extends below the tube 132 and a second lip that extends outwardly from the tube 132 (but not a lip that extends upwardly from the tube 132). It should be appreciated that in other embodiments of the present disclosure, the stop 134 can include a first lip that extends above the tube 132 and a second lip that extends downwardly from the tube 132 (but not a lip that extends outwardly from the tube 132).

The third lever 150 includes an elongated member such as the elongated rectangular tube or tubular member 152 having: (1) a first end 152*a*; (3) a second end 152*b* opposite the first end 152*a*; and (3) an intermediate portion 152*c* extending between the first end 152*a* and the second end 152*b*. As best shown in FIG. 6, the elongated rectangular tube 152 includes an interior surface 152*d* and an exterior surface 152*e*. The exterior surface 152*e* includes a first outwardly facing surface 152*f*, a second side surface 152*g*, a top surface 152*h*, and a bottom surface 152*i*. The third lever 150 includes suitable first and second end walls suitably integrally fixedly connected to the respective first end 152*a* and the second end 152*b*.

The third lever 150 also includes four connectors, and more specifically two spaced apart first lever connectors 160 and 170 for slidably connecting the first and third levers 110 and 150, and two spaced apart second lever connectors 180 and 190 for slidably connecting the second and third levers 130 and 150. More specifically: (1) connector 160 is suitably integrally fixedly connected to the top and bottom surfaces 152*h* and 152*i* of the elongated tube 152; (2) connector 170 is suitably integrally fixedly connected to the top and bottom surfaces 152*h* and 152*i* of the elongated tube 152; (3) connector 180 is suitably integrally fixedly connected to the top and bottom surfaces 152*h* and 152*i* of the elongated tube 152; and (4) connector 190 is suitably integrally fixedly connected to the top and bottom surfaces 152*h* and 152*i* of the elongated tube 152.

In this example embodiment, each of the connectors includes: (1) an outer wall; (2) a first (top) wall; and (3) a second (bottom) wall. The first (top) wall of each connector is suitably integrally fixedly connected to the top surface 152*h* of the elongated tube 152 of the third lever 150. The second (bottom) wall of each connector is suitably integrally fixedly connected to the bottom surface 152*i* of the elongated tube 152 of the third lever 150. As best shown in FIG. 6, the outer wall of each connector is spaced apart from the respective side surface (i.e., either side surface 152*g* or side surface 152*f*) of the elongated tube 152 of the third lever 150. Thus, each connector defines (in combination with the elongated tube 152) an opening for receiving a respective one of the first or second members 112 and 132 of the respective levers 110 and 130.

The third lever 150 also includes separate individual glides bonded to the respective three interior surfaces of each connector and the respective exterior side surfaces of the elongated tube 152 that together also further define each respective opening for receiving a respective one of the first and second levers 110 and 130. Each of the glides are longitudinally shorter than the respective connector and is thus generally contained within that connector. Thus, the third lever includes: (1) a plurality of first glides bonded to the respective interior surfaces of the first lever connectors 160 and 170 for engagement with the first lever 112; (2) a plurality of second glides bonded to the respective interior surfaces of the second lever connectors 180 and 190 for engagement with the second lever 132; (3) a plurality of spaced-apart third glides bonded to the exterior side surface 152*g* of the third lever 152 for engagement with the first lever 112; and (4) a plurality of spaced-apart fourth glides bonded to exterior side surface 152*f* of the third lever 152 for engagement with the second lever 132.

More specifically, for example, as best shown in FIG. 6, in this example embodiment, connector 180 includes: (1) an outer wall 182; (2) a first (top) wall 184; and (3) a second (bottom) wall 186. The first (top) wall 184 is suitably integrally fixedly connected to the top surface 152*h* of the elongated tube 152 of the third lever 150. The second (bottom) wall 186 is suitably integrally fixedly connected to the bottom surface 152*i* of the elongated tube 152 of the third lever 150. The outer wall 182 is spaced apart from the respective surface 152*f* of the elongated tube 152 of the third lever 150.

The third lever 150 further includes: (1) a first glide 183 integrally bonded to the inwardly facing interior surface of the outer wall 182 of the connector 180; (2) a second glide 185 integrally bonded, to the downwardly facing interior surface of the first (top) wall 184 of the connector 180; (3) a third glide 187 integrally bonded to the upwardly facing interior surface of the second (bottom) wall 186 of the connector 180; and (4) a fourth glide 189 integrally bonded to the outwardly facing exterior side surface 152*f* of the elongated tube 152 of the third lever 150. The second lever 130 is slidably received within the opening partially defined by the connector 180 and the more specifically the opening defined by the glides 183, 185, and 187 bonded to the connector 180 and the glide 189 bonded to the elongated tube 152 of the lever 150.

Likewise, as best shown in FIG. 6, in this example embodiment, connector 190 includes: (1) an outer wall 192; (2) a first (top) wall 194; and (3) a second (bottom) wall 196. The first (top) wall 194 is suitably integrally fixedly connected to the top surface 152*h* of the elongated tube 152 of the third lever 150. The second (bottom) wall 196 is suitably integrally fixedly connected to the bottom surface 152*i* of the elongated tube 152 of the third lever 150. The outer wall 192 is spaced apart from the respective side surface 152*f* of the elongated tube 152 of the third lever 150.

The third lever 150 further includes: (1) a first glide 193 integrally bonded to the inwardly facing interior surface of the outer wall 192 of the connector 190; (2) a second glide 195 integrally bonded to the downwardly facing interior surface of the first (top) wall 194 of the connector 190; (3) a third glide 197 integrally bonded to the upwardly facing interior surface of the second (bottom) wall 196 of the connector 190; and (4) a fourth glide (not shown or labeled) integrally bonded to the exterior side surface 152*f* of the elongated tube 152 of the third lever 152 (similar to glide 189). The second lever 130 is slidably received within the opening partially defined by the connector 190 and the more specifically the opening defined by the glides 193, 195, and 197 bonded to the connector 190 and the glide (not shown or labeled) bonded to the respective side surface of the elongated tube 152 of the lever 150.

Likewise, although not specifically labeled, in this example embodiment, connector 160 includes: (1) an outer wall; (2) a first (top) wall; and (3) a second (bottom) wall. The first (top) wall is suitably integrally fixedly connected to the top surface 152*h* of the elongated tube 152 of the third lever 150. The second (bottom) wall is suitably integrally fixedly connected to the bottom surface 152*i* of the elongated tube 152 of the third lever 150. The outer wall is spaced apart from the respective side surface 152*f* of the elongated tube 152 of the third lever 150. Likewise, although not specifically shown or labeled, in this example embodiment, the third lever 150 further includes: (1) a first glide integrally bonded to the inwardly facing interior surface of the outer wall of the connector 160; (2) a second glide integrally bonded to the downwardly facing interior surface of the first (top) wall of the connector 160; (3) a third glide integrally bonded to the upwardly facing interior surface of the second (bottom) wall of the connector 160; and (4) a fourth glide integrally bonded to the exterior side surface 152*g* of the elongated tube 152 of the third lever 152. The first lever 110 is slidably received within the opening partially defined by the connector 160 and the more specifically the opening defined by the glides bonded to the connector and the corresponding glide bonded to the respective side surface of the elongated tube 152 of the lever 150.

Likewise, although not specifically labeled, in this example embodiment, connector 170 likewise includes: (1) an outer wall; (2) a first (top) wall; and (3) a second (bottom) wall. The first (top) wall is suitably integrally fixedly connected to the top surface 152*h* of the elongated tube 152 of the third lever 150. The second (bottom) wall is suitably integrally fixedly connected to the bottom surface 152*i* of the elongated tube 152 of the third lever 150. The outer wall is spaced apart from the respective exterior side surface 152*g* of the elongated tube 152 of the third lever 150. Likewise, although not specifically shown or labeled, in this example embodiment, the third lever 150 further includes: (1) a first glide integrally bonded to the inwardly facing interior surface of the outer wall of the connector 170; (2) a second glide integrally bonded to the downwardly facing interior surface of the first (top) wall of the connector 170; (3) a third glide integrally bonded to the upwardly facing interior surface of the second (bottom) wall of the connector 170; and (4) a fourth glide integrally bonded to the exterior side surface 152*g* of the elongated tube 152 of the third lever 150. The first lever 110 is slidably received within the opening partially defined by the connector 170 and the more specifically the opening defined by the glides bonded to the connector 170 and the corresponding glide bonded to the respective side surface of the elongated tube 152 of the lever 150.

The hook 120 is located at a hook end of the uncoupling lever assembly 100, and more specifically, the hook 120 is suitably integrally fixedly connected to the first end 112*a* of the elongated tube 112 of the first lever 110. The hook 120 is connectable with a lock lifter (not shown) in a conventional manner. As mentioned above, the lock lifter is a part of the coupler assembly used to release the coupler assembly so that adjacent coupler assemblies on adjacent railroad cars may be released from each other to separate the adjacent railroad cars. It should be appreciated that the lock lifter is partly on the underside of the coupler assembly 40 and is hidden in FIG. 2, which generally shows how the uncoupling lever assembly 100 is connected to the frame 14 of the railroad car 10 and the coupler assembly 40.

The handle 140 is located at a handle end of the uncoupling lever assembly 100, and more specifically, the handle 140 is suitably integrally fixedly connected to the second end 132*b* of the elongated tube 132 of the second lever 130. The handle 140 is connectable to the clevis 80 which in turn is fixedly connected to the bracket 90 that extends from the frame 14 of the railroad car 10 as generally shown in FIG. 2. The uncoupling lever assembly 100 is thus pivotally connected to the frame 14 of the railroad car 10 by the handle 140 and connected by the hook 120 to the lock lifter of the coupler assembly 40. The handle 140 is rotatable by an operator to cause the hook 120 to rotate to lift the lock lifter to open the coupler assembly in a conventional manner.

In this illustrated example embodiment: (1) the first, second, and third elongated members 112, 132, and 152 are steel; (2) the connectors 160, 170, 180, and 190 are steel; (3) the respective top and bottom walls of each of the connectors 160, 170, 180, and 190 are each respectively welded to the top and bottom exterior surfaces of the elongated member 152 of the third lever 150; (4) the stops 114 and 134 are steel; (5) the stops 114 and 134 are respectively welded to the respective ends of the elongated member 112 and 132; (6) the end walls are steel; (7) the end walls are suitably welded to the opposite ends of the elongated member 152; (8) the hook 120 is steel; (9) the hook 120 is welded to the first end of the elongated member 112; (10) the handle 140 is steel; and (11) the handle 140 is welded to the second end of the elongated member 132.

In this illustrated example embodiment, each of the glides is made from a suitable plastic material such as a polyurethane and bonded to the respective surfaces of the connectors 160, 170, 180, and 190 and to the exterior side surfaces of the end of the elongated member 152. It should be appreciated that the glides can be made from other suitable materials, such as but not limited to, an ultra-high molecular weight polyethylene, or other plastics.

The glides ensure no metal-to-metal contact occurs: (1) between the exterior surfaces of the elongated members 112 and 152; (2) between the exterior surfaces of the elongated members 132 and 152; (3) between the interior surfaces of the connectors 160 and 170 and the elongated member 112; and (4) between the interior surfaces of the connectors 180 and 190 and the elongated member 152. As mentioned above, each glide is shorter in its longitudinal direction than the corresponding connector that it is bonded to or associated with such that no part of the glide extends beyond the longitudinal ends of that connector. This prevents ultraviolet light from directly striking the glide.

It should thus be appreciated from the above that the hook 120 is configured to be connected to the lock lifter and the handle 140 is configured to be hung on the U-shaped clevis 80 (that is connected to a bracket 90 which is in turn connected to the frame 14 of the railroad car 10) such that when: (1) the coupler 40 moves laterally relative to the railroad car 10; and/or (2) the coupler 40 extends or retracts, such that the distance between the lock lifter and the clevis 80 change, the first and second levers 110 and 130 slide relative to the third lever 150. This enables the overall length of the uncoupling lever assembly 100 to change to accommodate movement of the coupler 40 relative to the frame 14 of the railroad car 10. The glides bonded to the respective surfaces prevent the levers from binding. The glides are also less likely to be disconnected from (or fall out of) from the connectors.

In this illustrated example embodiment, the levers 110, 130 and 150 include elongated steel tubes that function as the elongated members 112, 132 and 152. It should be appreciated that in alternative embodiments, one or more of the levers can include elongated solid steel bars instead of elongated tubes.

In this illustrated example embodiment, the third lever 150 includes a plurality of spaced apart third glides bonded to an exterior first side surface of the third lever for engagement with the first lever, and a plurality of spaced apart fourth glides bonded to an exterior second side surface of the third lever for engagement with the second lever. In other embodiments of the present disclosure, the third lever 150 includes a single third glide bonded to the exterior first side surface of the third lever for engagement with the first lever, and a single fourth glide bonded to the exterior second side surface of the third lever for engagement with the second lever.

In other embodiments of the present disclosure, the third lever 150 does not include any glides bonded to the exterior first or second side surfaces of the third lever for engagement with the first lever or the second lever. In such embodiments, the other glides bonded to the connectors can be suitably configured with suitable tolerances to receive the respective first and second levers such that glides bonded to the third lever are not needed.

It should also be appreciated that two or more of the glides bonded to the interior surfaces of a connector can be suitably connected in accordance with the present disclosure.

Figure 8:
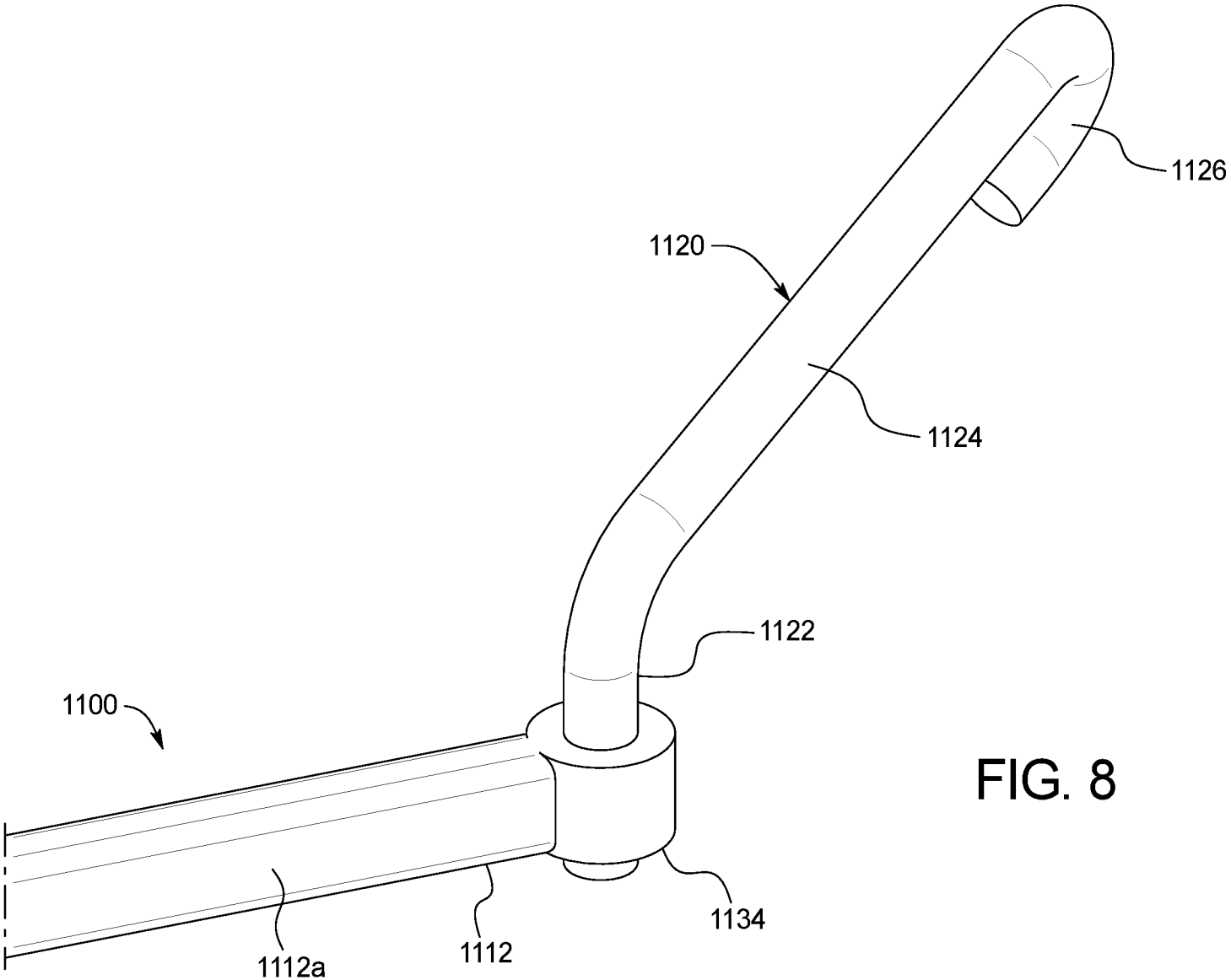
FIG. 8 is an enlarged fragmentary perspective view of part of an uncoupling lever assembly of another example embodiment of the present disclosure.
Figure 9:
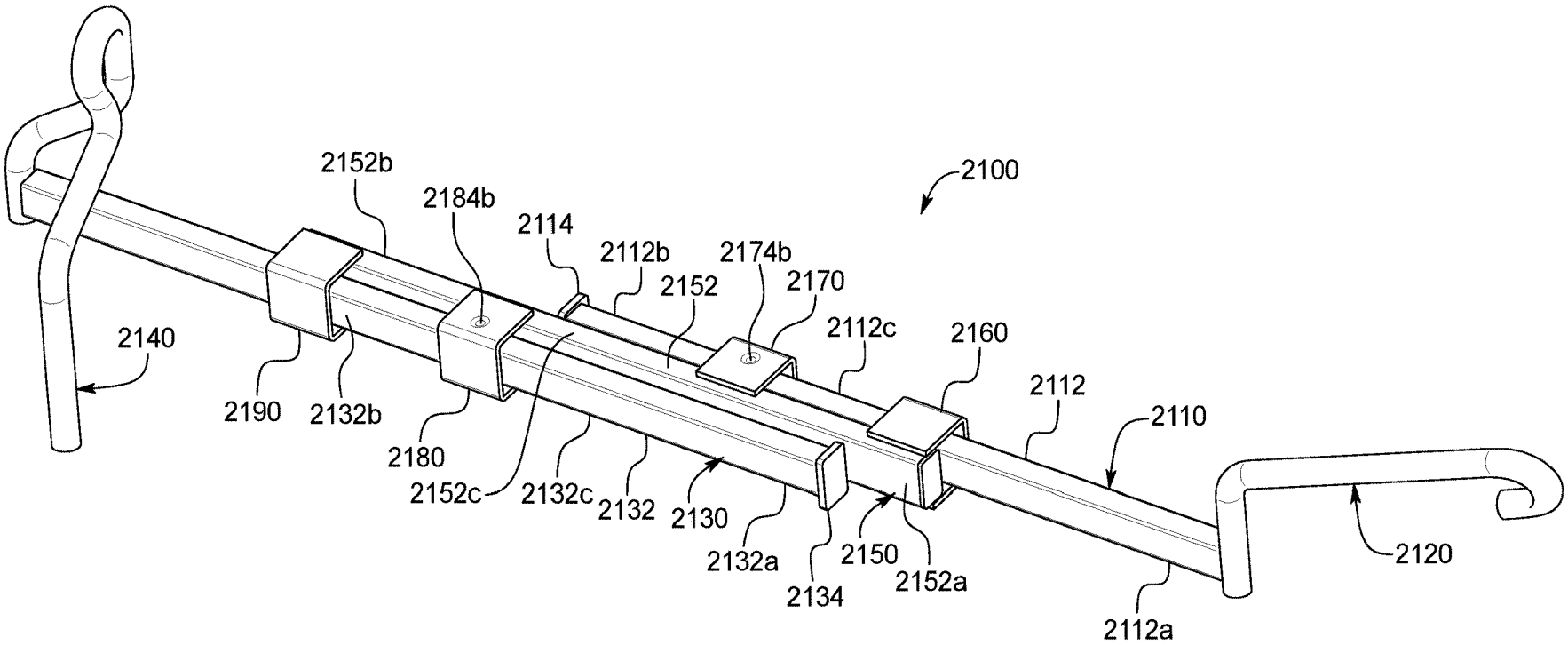
FIG. 9 is an enlarged top front perspective view of the uncoupling lever assembly of another example embodiment of the present disclosure.
Figure 10:
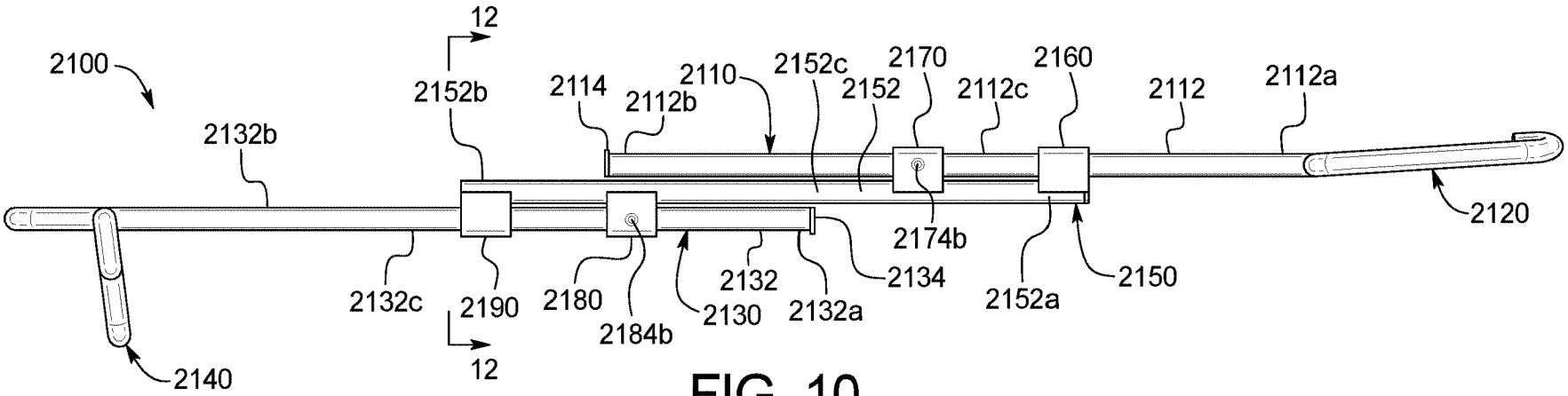
FIG. 10 is an enlarged top view of the uncoupling lever assembly of FIG. 9.
Figure 11:
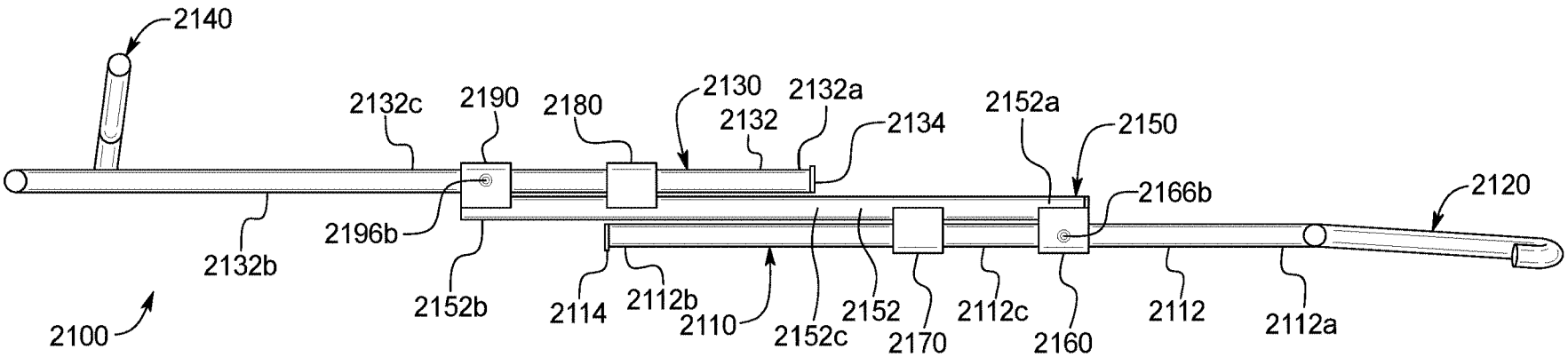
FIG. 11 is an enlarged bottom view of the uncoupling lever assembly of FIG. 9.
Figure 12:
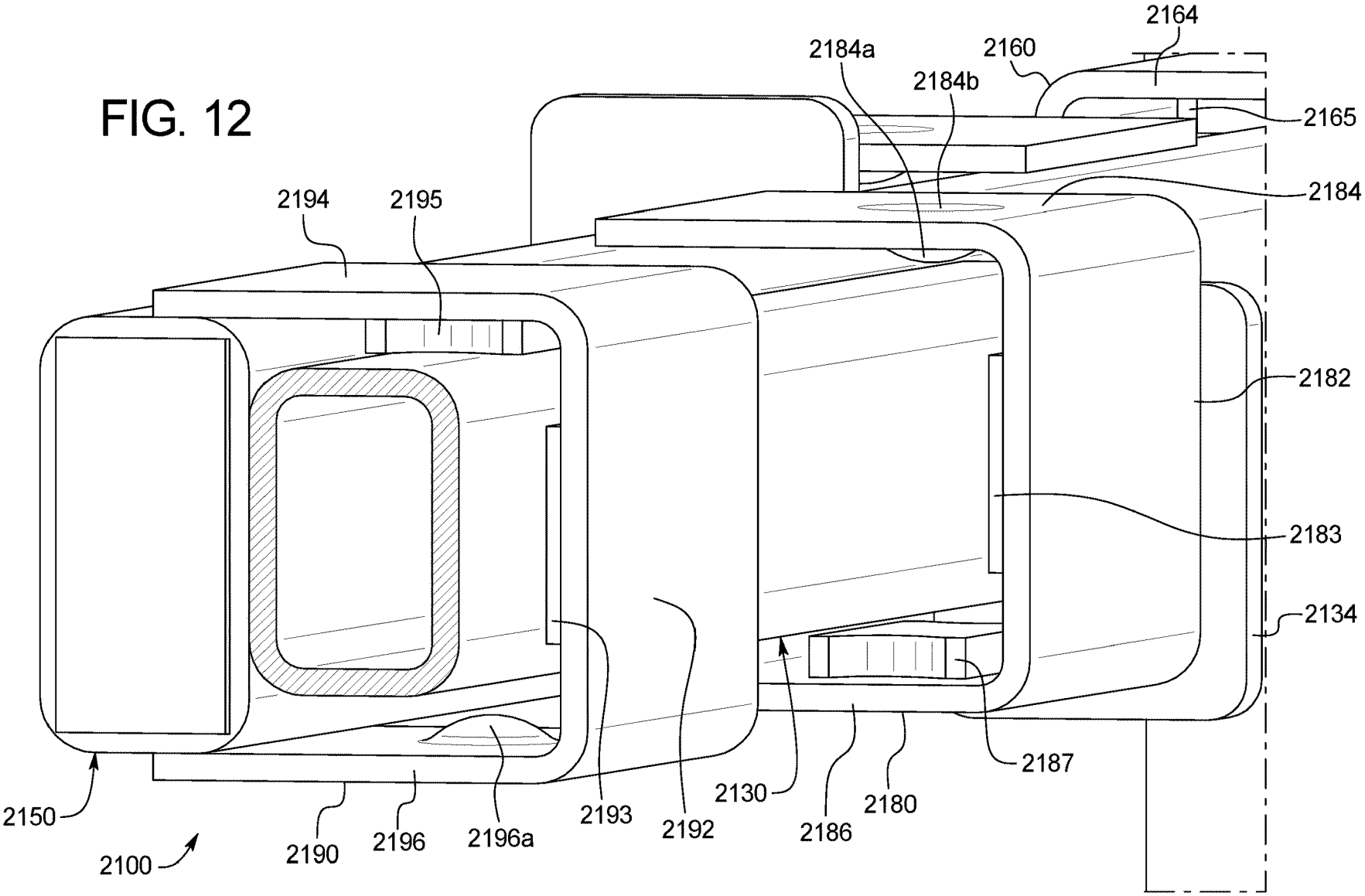
FIG. 12 is a further enlarged fragmentary perspective view and partial vertical cross sectional view of part of the uncoupling lever assembly of FIG. 9.
Figure 13:
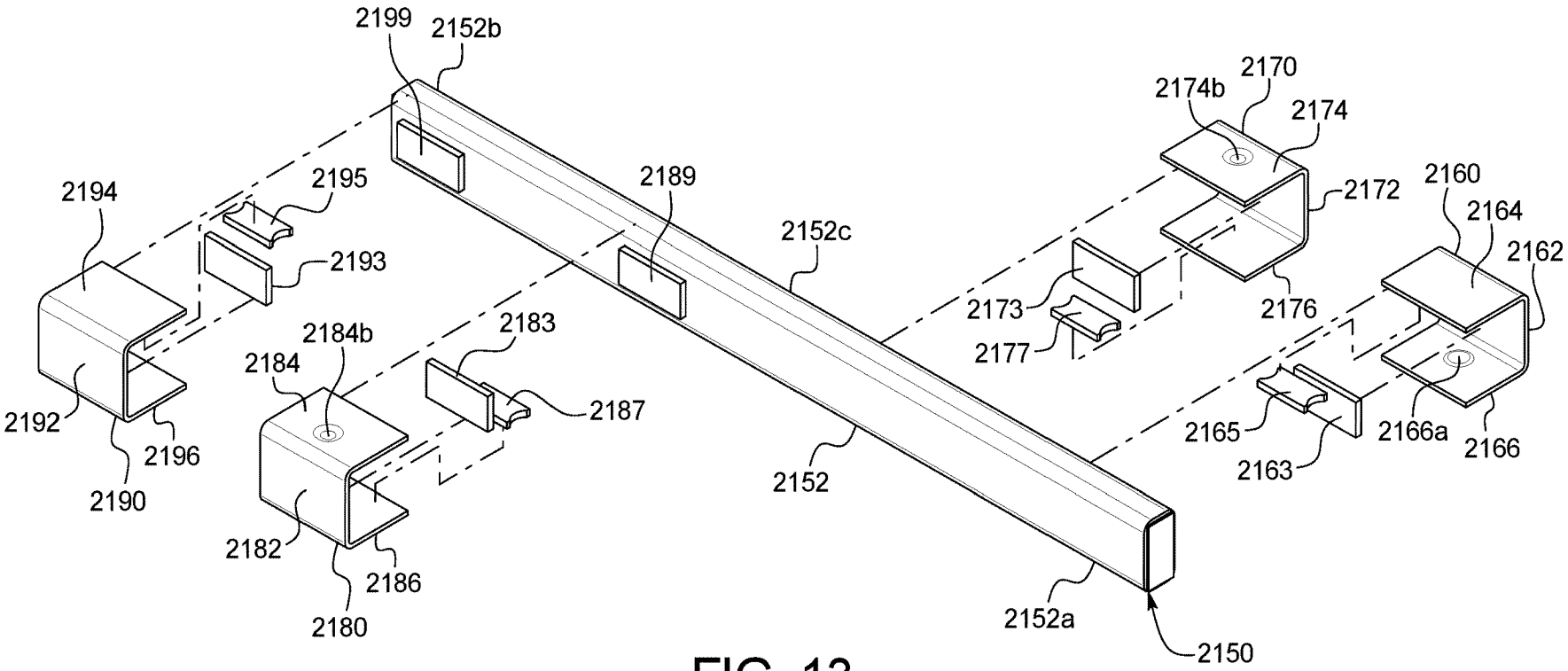
FIG. 13 is an exploded perspective view of part of the uncoupling lever assembly of FIG. 9.
Figure 14:
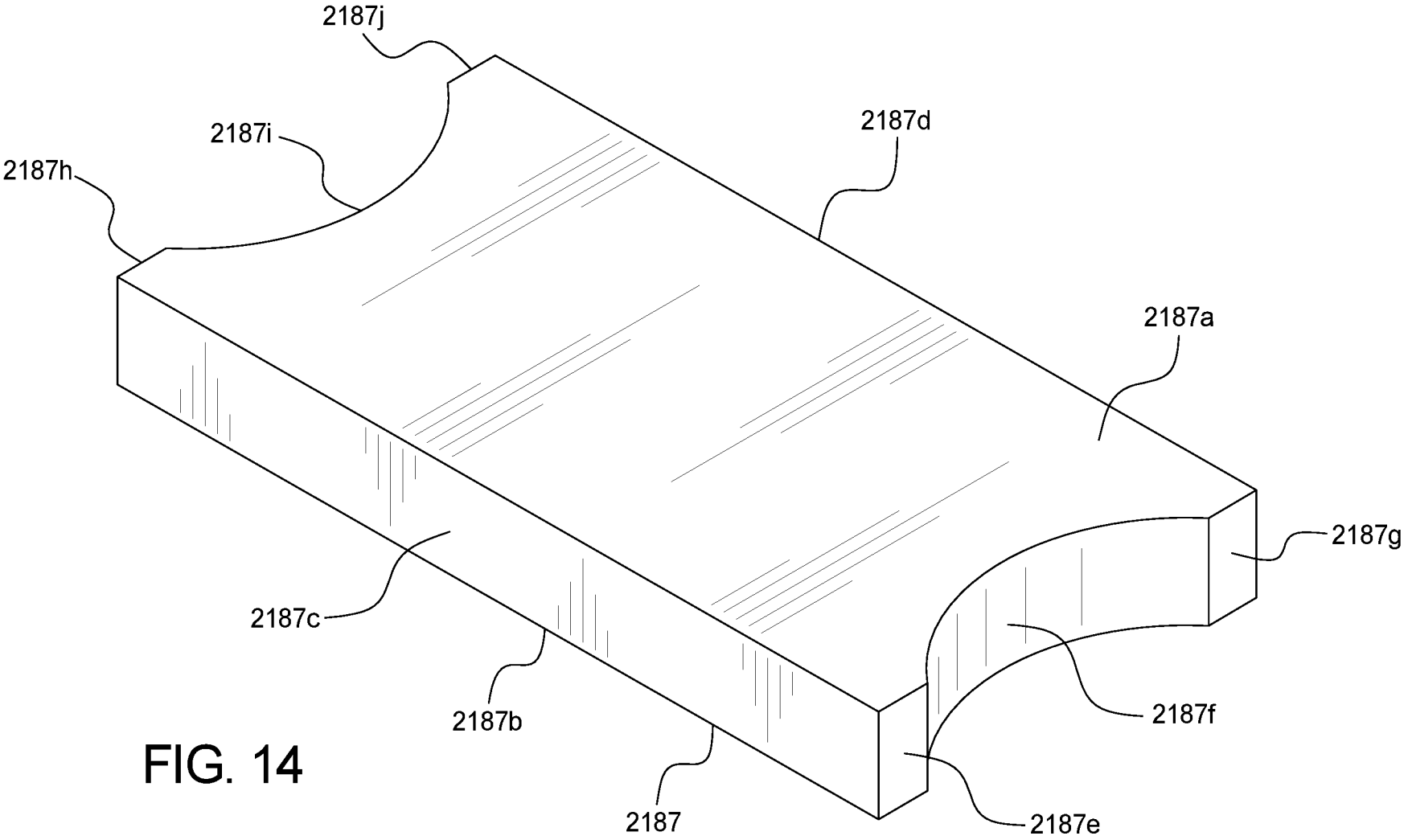
FIG. 14 is an enlarged perspective view of one of the glides of the uncoupling lever assembly of FIG. 9.

Referring now to FIG. 8, another example embodiment of the uncoupling lever assembly of the present disclosure is partially shown. This example uncoupling lever assembly 1100 generally includes substantially the same components of the uncoupling lever assembly 100 described above, except that it includes a different hook 1120. In this illustrated example embodiment, the first lever 1000 includes a pivot member 1134 connected to the first end 1112*a* of the elongated tube or member 1112. The hook 1120 is pivotally connected to the pivot member 1134 and thus pivotally connected to the first end 1112*a* of the tube 1112 and the lever 1100. The hook 1120 includes a leg 1122 pivotally connected to the pivot member 1134, an extension body 1124 connected to the leg 1122, and a hooking hand 1126 connected to the body 1124. In certain such embodiments, the amount of rotation is limited by a suitable limiting member such as a key. By including a pivotal connection instead of a fixed connection between hook 1120 and tube 1112, the potential for Euler buckling of the leg 1112 is mitigated. This adjusted boundary condition on the lever assembly of a pivotal connection promotes a lower critical load required to buckle member 1112 when subjected to compression forces.

Referring now to FIGS. 9, 10, 11, 12, 13, and 14, another example embodiment of the uncoupling lever assembly of the present disclosure is shown. This alternative example telescoping uncoupling lever assembly is generally indicated by numeral 2100. In this illustrated example embodiment, the example uncoupling lever assembly 2100 is configured to pivotally connect to a lock lifter of the coupler assembly 40 and to a clevis 80 connected to a bracket 90 that in turn is connected to the frame 14 of the railroad car 10. However, it should be appreciated that this example embodiment (as well as any of the other embodiments disclosed herein) can be employed in vehicles other than railroad cars. Generally, in this alternative example, the positions of certain of the glides are changed, the shapes of certain of the glides are changed, and the configurations of the connectors are changed, all as further discussed below.

In this illustrated example embodiment, the uncoupling lever assembly 2100 includes: (1) a first lever 2110; (2) a hook 2120 connected to the first lever 2110; (3) a second lever 2130; (4) a handle 2140 connected to the second lever 2130; and (5) a third lever 2150 slidably connected to the first lever 2110 and the second lever 2130, and slidably connecting the first lever 2110 and the second lever 2130.

The first lever 2110 includes an elongated member such as the elongated rectangular tube or tubular member 2112 having: (1) a first end 2112*a*; (3) a second end 2112*b* opposite the first end 2112*a*; and (3) an intermediate portion 2112*c* extending between the first end 2112*a* and the second end 2112*b*. The elongated rectangular tube 1112 includes an interior surface (not labeled) and an exterior surface (not labeled). The exterior surface includes a first side surface (not labeled), a second side surface (not labeled), a top surface (not labeled), and a bottom surface (not labeled).

The first lever 2110 includes a stop 2114 suitably integrally fixedly connected to the second end 2112*b* of the elongated tube 2112. The stop 114 is configured to engage the outer end edges (not labeled) of the connector 2170 to prevent the tube 2112 from sliding out of the connectors 2170 and 2160. The stop 2114 has a greater width than the tube 2112 and a greater height than the tube 2112. More specifically, in this illustrated example embodiment, the stop 2114 includes a first lip (not labeled) that extends above the tube 2112, a second lip (not labeled) that extends below the tube 2112, and a third lip (not labeled) that extends outwardly from the tube 2112. These three lips co-act to provide a significant engagement area with the side edges of the connector 2170 to suitably spread out the force that occurs when the stop 2114 engages the connector 2170 such that the stop 2114 and the connector 2170 are less likely to break. This reduces the chance that the first lever 2110 will become disconnected from the third lever 2150. It should be appreciated that in other embodiments of the present disclosure, the stop 2114 can include a first lip that extends above the tube 2112 and a second lip that extends outwardly from the tube 2112 (but not a lip that extends downwardly from the tube 2112). It should be appreciated that in other embodiments of the present disclosure, the stop 2114 can include a first lip that extends below the tube 2112 and a second lip that extends outwardly from the tube 2112 (but not a lip that extends upwardly from the tube 2112). It should be appreciated that in other embodiments of the present disclosure, the stop 2114 can include a first lip that extends above the tube 2112 and a second lip that extends downwardly from the tube 2112 (but not a lip that extends outwardly from the tube 2112).

The second lever 2130 includes an elongated member such as the elongated rectangular tube or tubular member 2132 having: (1) a first end 2132*a*; (3) a second end 2132*b* opposite the first end 2132*a*; and (3) an intermediate portion 2132*c* extending between the first end 2132*a* and the second end 2132*b*. The elongated rectangular tube 2132 includes an interior surface (not labeled) and an exterior surface (not labeled). The exterior surface includes a first side surface (not labeled), a second side surface (not labeled), a top surface (not labeled), and a bottom surface (not labeled).

The second lever 2130 includes a stop 2134 suitably integrally fixedly connected to the first end 2132*a* of the elongated tube 2132. The stop 2134 is configured to engage the outer end edges (not labeled) of the connector 2180 to prevent the tube 2132 from sliding out of the connectors 2180 and 2190. The stop 2134 has a greater width than the tube 2132 and a greater height than the tube 2132. More specifically, the stop 2134 includes a first lip (not labeled) that extends above the tube 2132, a second lip (not labeled) that extends outwardly from the tube 2132, and a third lip (not labeled) that extends below the tube 132. These three lips co-act to provide a significant engagement area with the side edges of the connector 2180 to suitably spread out the force that occurs when the stop 134 engages the connector 2180 such that the stop 2134 and the connector 2180 are less likely to break. It should be appreciated that in other embodiments of the present disclosure, the stop 2134 can include a first lip that extends above the tube 2132 and a second lip that extends outwardly from the tube 2132 (but not a lip that extends downwardly from the tube 2132). It should be appreciated that in other embodiments of the present disclosure, the stop 2134 can include a first lip that extends below the tube 2132 and a second lip that extends outwardly from the tube 2132 (but not a lip that extends upwardly from the tube 2132). It should be appreciated that in other embodiments of the present disclosure, the stop 2134 can include a first lip that extends above the tube 2132 and a second lip that extends downwardly from the tube 2132 (but not a lip that extends outwardly from the tube 2132).

The third lever 2150 includes an elongated member such as the elongated rectangular tube or tubular member 2152 having: (1) a first end 152*a*; (3) a second end 2152*b* opposite the first end 2152*a*; and (3) an intermediate portion 2152*c* extending between the first end 2152*a* and the second end 2152*b*. The elongated rectangular tube 2152 includes an interior surface (not labeled) and an exterior surface (not labeled). The exterior surface includes a first outwardly facing surface (not labeled), a second side surface (not labeled), a top surface (not labeled), and a bottom surface (not labeled). The third lever 2150 includes suitable first and second end walls suitably integrally fixedly connected to the respective first end 2152*a* and the second end 2152*b*.

The third lever 2150 includes the two spaced apart first lever connectors 2160 and 2170 for slidably connecting the first and third levers 2110 and 2150, and the two spaced apart second lever connectors 2180 and 2190 for slidably connecting the second and third levers 2130 and 2150. More specifically: (1) connector 2160 is suitably integrally fixedly connected to the top and bottom surfaces and of the elongated tube 2152; (2) connector 2170 is suitably integrally fixedly connected to the top and bottom surfaces of the elongated tube 2152; (3) connector 2180 is suitably integrally fixedly connected to the top and bottom surfaces of the elongated tube 2152; and (4) connector 2190 is suitably integrally fixedly connected to the top and bottom surfaces of the elongated tube 2152.

In this example embodiment, each of the connectors includes: (1) an outer wall; (2) a first (top) wall; and (3) a second (bottom) wall. The first (top) wall of each connector is suitably integrally fixedly connected to the top surface of the elongated tube 2152 of the third lever 2150. The second (bottom) wall of each connector is suitably integrally fixedly connected to the bottom surface of the elongated tube 2152 of the third lever 2150. The outer wall of each connector is spaced apart from the respective side surface of the elongated tube 2152 of the third lever 2150. Thus, each connector defines (in combination with the elongated tube 2152) an opening for receiving a respective one of the first or second members 2112 and 2132 of the respective levers 2110 and 2130.

As further described below, the third lever 2150 also includes separate individual glides bonded to certain of the interior surfaces of each connector and separate individual glides bonded to the respective exterior side surfaces of the elongated tube 2152 that together also further define each respective opening for receiving a respective one of the first and second levers 2110 and 2130. Each of the glides are longitudinally shorter than the respective connector and is thus generally contained within that connector.

Thus, the third lever 2150 includes: (1) a plurality of first glides bonded to the respective interior surfaces of the first lever connectors 2160 and 2170 for engagement with the first lever 112; (2) a plurality of second glides bonded to the respective interior surfaces of the second lever connectors 2180 and 2190 for engagement with the second lever 132; (3) a plurality of spaced-apart third glides bonded to the exterior side surface of the third lever 2152 for engagement with the first lever 2112; and (4) a plurality of spaced-apart fourth glides bonded to exterior side surface of the third lever 2152 for engagement with the second lever 2132.

More specifically, for example, in this example embodiment, connector 2180 includes: (1) an outer wall 2182; (2) a first (top) wall 2184; and (3) a second (bottom) wall 2186. The first (top) wall 2184 is suitably integrally fixedly connected to the top surface of the elongated tube 2152 of the third lever 2150. The second (bottom) wall 2186 is suitably integrally fixedly connected to the bottom surface of the elongated tube 2152 of the third lever 2150. The outer wall 2182 is spaced apart from the respective surface of the elongated tube 2152 of the third lever 2150. The first (top) wall 2184 includes an inwardly and downwardly extending dimple 2184*a* and defines an inwardly and downwardly extending indentation 2184*b* (in its upper surface). The dimple 2184*a* is configured to engage the top surface of the elongated member 2132 of the second lever 2130. The dimple 2184*a* replaces the glide from embodiment of FIGS. 2 to 7 to reduce binding between the first and third levers.

The third lever 2150 further includes: (1) a first glide 2183 integrally bonded to the inwardly facing interior surface of the outer wall 2182 of the connector 180; (2) a second glide 2187 integrally bonded to the upwardly facing interior surface of the second (bottom) wall 2186 of the connector 2180; and (3) a third glide 2189 integrally bonded to the outwardly facing exterior side surface of the elongated tube 2152 of the third lever 2150. The second lever 2130 is slidably received within the opening partially defined by the connector 2180 and the more specifically the opening defined by the glides 2183 and 2187 bonded to the connector 2180 and the glide 2189 bonded to the elongated tube 2152 of the lever 2150. In this illustrated example embodiment, the first glide 2183 is generally rectangular, and the third glide 2189 is generally rectangular, although it should be appreciated that these glides can be otherwise suitably configured. In this illustrated example embodiment, second glide 2187 is generally rectangular but includes semi-circular end indentations. This second glide 2187 is further shown in FIG. 14, and includes: (1) a top surface 2187*a*; (2) a bottom surface 2187*b*; (3) a first side surface 2187*c*; (4) a second side surface 2187*d*; (5) a first end including end surfaces 2187*e*, 2187*f*, and 2187*g*; and (5) a second end including end surfaces 2187*h*, 2187*i*, and 2187*j*. The ends or end surfaces 2187*f* and 2187*i* of the glide 2187 are curved or partially cylindrical. Thus, the ends of the glide 2187 include surfaces that define pockets that are configured to assist in removing debris (such as sand) on the top surface of the elongated member 2112 of the first lever 2110. It should be appreciated that this alternative glide can be otherwise suitably configured in accordance with the present disclosure.

In this example embodiment, connector 2190 includes: (1) an outer wall 2192; (2) a first (top) wall 2194; and (3) a second (bottom) wall 2196. The first (top) wall 2194 is suitably integrally fixedly connected to the top surface of the elongated tube 2152 of the third lever 2150. The second (bottom) wall 2196 is suitably integrally fixedly connected to the bottom surface of the elongated tube 2152 of the third lever 2150. The outer wall 2192 is spaced apart from the respective side surface of the elongated tube 2152 of the third lever 2150. The second (bottom) wall 2196 includes an inwardly and upwardly extending dimple 2196*a* and defines an inwardly and upwardly extending indentation 2196*b* (in its bottom surface). The dimple 2196*a* is configured to engage the bottom surface of the elongated member 2132 of the second lever 2130. The dimple 2196*a* replaces the glide from embodiment of FIGS. 2 to 7 to reduce binding between the first and third levers.

The third lever 2150 further includes: (1) a first glide 2193 integrally bonded to the inwardly facing interior surface of the outer wall 2192 of the connector 2190; (2) a second glide 2195 integrally bonded to the downwardly facing interior surface of the first (top) wall 2194 of the connector 2190; and (3) a third glide 2199 integrally bonded to the exterior side surface of the elongated tube 2152 of the third lever 2152. The second lever 2130 is slidably received within the opening partially defined by the connector 2190 and the more specifically the opening defined by the glides 2193 and 2195 bonded to the connector 2190 and the glide 2199 bonded to the respective side surface of the elongated tube 2152 of the lever 2150. In this illustrated example embodiment, the first glide 2193 is generally rectangular, and the third glide 2199 is generally rectangular, although it should be appreciated that these glides can be otherwise suitably configured. In this illustrated example embodiment, second glide 2195 is generally rectangular but includes semi-circular end indentations. The second glide 2195 is configured similar to the glide 2187 and functions in the same manner. It should be appreciated that the second glide 2195 can be alternatively configured.

In this example embodiment, connector 2160 includes: (1) an outer wall 2162; (2) a first (top) wall 2164; and (3) a second (bottom) wall 2166. The first (top) wall 2164 is suitably integrally fixedly connected to the top surface of the elongated tube 2152 of the third lever 2150. The second (bottom) wall 2166 is suitably integrally fixedly connected to the bottom surface of the elongated tube 2152 of the third lever 2150. The outer wall 2162 is spaced apart from the respective side surface of the elongated tube 2152 of the third lever 2150. The second (bottom) wall 2160 includes an inwardly and upwardly extending dimple 2166*a* and defines an inwardly and upwardly extending indentation 2166*b* (in its bottom surface). The dimple 2166*a* is configured to engage the bottom surface of the elongated member 2112 of the second lever 2110. The dimple 2166*a* replaces the glide from embodiment of FIGS. 2 to 7 to reduce binding between the first and third levers.

In this example embodiment, the third lever 2150 further includes: (1) a first glide 2163 integrally bonded to the inwardly facing interior surface of the outer wall 2162 of the connector 2160; (2) a second glide 2165 integrally bonded to the downwardly facing interior surface of the first (top) wall 2164 of the connector 2160 and (3) a third glide (not shown or labeled) integrally bonded to the exterior side surface of the elongated tube 2152 of the third lever 2152. The first lever 2110 is slidably received within the opening partially defined by the connector 2160 and the more specifically the opening defined by the glides 2163 and 2165 bonded to the connector and the corresponding glide bonded to the respective side surface of the elongated tube 2152 of the lever 2150. In this illustrated example embodiment, the first glide 2163 is generally rectangular, and the third glide (not shown or labeled) is generally rectangular, although it should be appreciated that these glides can be otherwise suitably configured. In this illustrated example embodiment, second glide 2165 is generally rectangular but includes semi-circular end indentations. The second glide 2165 is configured similar to the glide 2187 and functions in the same manner. It should be appreciated that the second glide 2165 can be alternatively configured.

In this example embodiment, connector 2170 includes: (1) an outer wall 2172; (2) a first (top) wall 2174; and (3) a second (bottom) wall 2176. The first (top) wall 2172 is suitably integrally fixedly connected to the top surface of the elongated tube 2152 of the third lever 2150. The second (bottom) wall 2176 is suitably integrally fixedly connected to the bottom surface of the elongated tube 2152 of the third lever 2150. The outer wall 2172 is spaced apart from the respective exterior side surface of the elongated tube 2152 of the third lever 2150. The first (top) wall 2174 includes an inwardly and downwardly extending dimple (not shown) and defines an inwardly and downwardly extending indentation 2174*b* (in its upper surface). The dimple is configured to engage the top surface of the elongated member 2112 of the second lever 2110. The dimple replaces the glide from embodiment of FIGS. 2 to 7 to reduce binding between the first and third levers.

In this example embodiment, the third lever 2150 further includes: (1) a first glide 2173 integrally bonded to the inwardly facing interior surface of the outer wall of the connector 2170; (2) a second glide 217 integrally bonded to the upwardly facing interior surface of the second (bottom) wall 2176 of the connector 2170; and (3) a third glide (not shown or labeled) integrally bonded to the exterior side surface of the elongated tube 2152 of the third lever 2150. The first lever 2110 is slidably received within the opening partially defined by the connector 2170 and the more specifically the opening defined by the glides 2173 and 2177 bonded to the connector 2170 and the corresponding glide bonded to the respective side surface of the elongated tube 2152 of the lever 2150. In this illustrated example embodiment, the first glide 2173 is generally rectangular, and the third glide (not shown or labeled) is generally rectangular, although it should be appreciated that these glides can be otherwise suitably configured. In this illustrated example embodiment, second glide 2177 is generally rectangular but includes semi-circular end indentations. The second glide 2177 is configured similar to the glide 2187 and functions in the same manner. It should be appreciated that the second glide 2177 can be alternatively configured.

The hook 2120 is located at a hook end of the uncoupling lever assembly 2100, and more specifically, the hook 2120 is suitably integrally fixedly connected to the first end 2112*a* of the elongated tube 2112 of the first lever 2110. The hook 2120 is connectable with a lock lifter (not shown) in a conventional manner.

The handle 2140 is located at a handle end of the uncoupling lever assembly 2100, and more specifically, the handle 2140 is suitably integrally fixedly connected to the second end 2132*b* of the elongated tube 2132 of the second lever 2130.

In this illustrated example embodiment: (1) the first, second, and third elongated members 2112, 2132, and 152 are steel; (2) the connectors 2160, 2170, 2180, and 2190 are steel; (3) the respective top and bottom walls of each of the connectors 2160, 2170, 2180, and 2190 are each respectively welded to the top and bottom exterior surfaces of the elongated member 2152 of the third lever 2150; (4) the stops 2114 and 2134 are steel; (5) the stops 2114 and 2134 are respectively welded to the respective ends of the elongated member 2112 and 2132; (6) the end walls are steel; (7) the end walls are suitably welded to the opposite ends of the elongated member 2152; (8) the hook 2120 is steel; (9) the hook 2120 is welded to the first end of the elongated member 2112; (10) the handle 2140 is steel; and (11) the handle 2140 is welded to the second end of the elongated member 2132.

In this illustrated example embodiment, each of the glides is made from a suitable plastic material such as a polyurethane and bonded to certain surfaces of the connectors 2160, 2170, 2180, and 2190 and to the exterior side surfaces of the end of the elongated member 2152. It should be appreciated that the glides can be made from other suitable materials, such as but not limited to, an ultra-high molecular weight polyethylene, or other plastics.

The glides minimize metal-to-metal contact: (1) between the exterior surfaces of the elongated members 2112 and 2152; (2) between the exterior surfaces of the elongated members 2132 and 2152; (3) between certain interior surfaces of the connectors 2160 and 2170 and the elongated member 2112; and (4) between certain interior surfaces of the connectors 2180 and 2190 and the elongated member 2152. As mentioned above, each glide is shorter in its longitudinal direction than the corresponding connector that it is bonded to or associated with such that no part of the glide extends beyond the longitudinal ends of that connector. This prevents ultraviolet light from directly striking the glide.

It should thus be appreciated from the above that the hook 2120 is configured to be connected to the lock lifter and the handle 140 is configured to be hung on the U-shaped clevis 80 (that is connected to a bracket 90 which is in turn connected to the frame 14 of the railroad car 10) such that when: (1) the coupler 40 moves laterally relative to the railroad car 10; and/or (2) the coupler 40 extends or retracts, such that the distance between the lock lifter and the clevis 80 change, the first and second levers 2110 and 2130 slide relative to the third lever 2150. This enables the overall length of the uncoupling lever assembly 2100 to change to accommodate movement of the coupler 40 relative to the frame 14 of the railroad car 10. The glides bonded to the respective surfaces prevent the levers from binding. The glides are also less likely to be disconnected from (or fall out of) from the connectors.

In this illustrated example embodiment, the levers 2110, 2130 and 2150 include elongated steel tubes that function as the elongated members 2112, 2132 and 2152. It should be appreciated that in alternative embodiments, one or more of the levers can include elongated solid steel bars instead of elongated tubes.

In this illustrated example embodiment, the third lever 2150 includes a plurality of spaced apart third glides bonded to an exterior first side surface of the third lever for engagement with the first lever, and a plurality of spaced apart fourth glides bonded to an exterior second side surface of the third lever for engagement with the second lever. In other embodiments of the present disclosure, the third lever 2150 includes a single third glide bonded to the exterior first side surface of the third lever for engagement with the first lever, and a single fourth glide bonded to the exterior second side surface of the third lever for engagement with the second lever.

In other embodiments of the present disclosure, the third lever 2150 does not include any glides bonded to the exterior first or second side surfaces of the third lever for engagement with the first lever or the second lever. In such embodiments, the other glides bonded to the connectors can be suitably configured with suitable tolerances to receive the respective first and second levers such that glides bonded to the third lever are not needed.

It should also be appreciated that two or more of the glides bonded to the interior surfaces of a connector can be suitably connected in accordance with the present disclosure.

It will be understood that modifications and variations may be effected without departing from the scope of the novel concepts of the present invention, and it is understood that this application is to be limited only by the scope of the claims.

The invention claimed is:

1. An uncoupling lever assembly comprising:

a first lever including a first elongated member;

a hook connected to a first end of the first elongated member, the hook connectable to a lock lifter of a coupler assembly of a railroad car;

a second lever including a second elongated member;

a handle connected to a second end of the second elongated member, the handle connectable to a frame of the railroad car; and a third lever including:

a third elongated member, a plurality of first lever connectors connected to the third elongated member, a plurality of second lever connectors connected to the third elongated member, a plurality of first glides bonded to interior surfaces of the first lever connectors and at least one third glide bonded to an exterior first side surface of the third elongated member to engage the first lever and such that the first lever is slidably received within the plurality of first glides bonded to the first lever connectors, and wherein the plurality of first glides are in face-sharing contact with only an outer surface of the first lever, and a plurality of second glides bonded to interior surfaces of the second lever connectors and at least one fourth glide bonded to an exterior second side surface of the third elongated member to engage the second lever and such that the second lever is slidably received within the second glides bonded to the second lever connectors, and wherein the plurality of second glides are in face-sharing contact with only an outer surface of the second lever, wherein the first lever is slidable relative to the third lever, and wherein the second lever is slidable relative to the third lever.

2. The uncoupling lever assembly of claim 1, wherein each connector includes a top wall, a bottom wall, and a side wall connected to one of the plurality of first glides or the plurality of second glides.

3. The uncoupling lever assembly of claim 1, wherein the at least one third glide is one of a plurality of spaced-apart third glides bonded to an exterior first side surface of the third elongated member to engage the first elongated member, and wherein the at least one fourth glide is one of a plurality of spaced-apart fourth glides bonded to an exterior second side surface of the third elongated member to engage with the second elongated member.

4. The uncoupling lever assembly of claim 1, wherein the first lever includes a first stop connected to a second end of the first elongated member and configured to engage one of the first connectors, wherein the first stop has a greater width than the first elongated member and a greater height than the first elongated member.

5. The uncoupling lever assembly of claim 4, wherein the first stop includes a first lip that extends above or below the first elongated member and a second lip that extends transversely beyond the first elongated member.

6. The uncoupling lever assembly of claim 4, wherein the second lever includes a second stop connected to a first end of the second elongated member and configured to engage one of the second connectors, wherein the second stop has a greater width than the second elongated member and a greater height than the second elongated member.

7. The uncoupling lever assembly of claim 6, wherein the second stop includes a first lip that extends above or below the second elongated member and a second lip that extends transversely beyond the second elongated member.

8. The uncoupling lever assembly of claim 1, wherein the first elongated member is tubular, the second elongated member is tubular, and the third elongated member is tubular.

9. The uncoupling lever assembly of claim 1, wherein the glides are polyurethane.

10. The uncoupling lever assembly of claim 1, wherein the hook is pivotally connected to a first end of the first elongated member.

11. The uncoupling lever assembly of claim 1, wherein each connector includes a top wall, a bottom wall, and a side wall connected to the top wall and the bottom wall, and wherein one of the top wall and the bottom wall includes an inwardly extending dimple.

12. The uncoupling lever assembly of claim 1, wherein a plurality of the first glides are each generally rectangular and define indentations in opposite ends.

13. The uncoupling lever assembly of claim 12, wherein a plurality of the second glides are each generally rectangular and define indentations in opposite ends.

14. An uncoupling lever assembly comprising:

a first lever including a first elongated member;

a hook connected to a first end of the first elongated member, the hook connectable to a lock lifter of a coupler assembly of a railroad car;

a second lever including a second elongated member;

a handle connected to a second end of the second elongated member, the handle connectable to a frame of the railroad car; and a third lever including:

a third elongated member, at least one first lever connector connected to the third elongated member, at least one second lever connector connected to the third elongated member, at least one first glide bonded an interior surface of the first lever connectors and at least one third glide bonded to an exterior first side surface of the third elongated member to engage with only an exterior of the first lever and such that the first lever is slidably received within the first glide bonded to the first lever connectors, and at least one second glide bonded an interior surface of the second lever connectors and at least one fourth glide bonded to an exterior second side surface of the third elongated member, the exterior second side surface opposite the exterior first side surface, to engage with only an exterior of the second lever and such that the second lever is slidably received within the second glide bonded to the second lever connectors, wherein the first lever is slidable relative to the third lever, and wherein the second lever is slidable relative to the third lever.

15. The uncoupling lever assembly of claim 14, wherein each connector includes a top wall, a bottom wall, and a side wall connected to the top wall and the bottom wall.

16. The uncoupling lever assembly of claim 14, wherein the first lever includes a first stop connected to a second end of the first elongated member and configured to engage one of the first connectors, wherein the first stop has a greater width than the first elongated member and a greater height than the first elongated member.

17. The uncoupling lever assembly of claim 16, wherein the second lever includes a second stop connected to a first end of the second elongated member and configured to engage one of the second connectors, wherein the second stop has a greater width than the second elongated member and a greater height than the second elongated member.

18. The uncoupling lever assembly of claim 16, wherein the first elongated member is tubular, the second elongated member is tubular, and the third elongated member is tubular.

19. The uncoupling lever assembly of claim 14, wherein the glides are polyurethane.

20. The uncoupling lever assembly of claim 14, wherein the hook is pivotally connected to a first end of the first elongated member.

21. An uncoupling lever assembly comprising:

a first lever including a first elongated member and a first stop fixedly connected to a second end of the first elongated member;

a hook connected to a first end of the first elongated member, the hook connectable to a lock lifter of a coupler assembly of a railroad car;

a second lever including a second elongated member and a second stop fixedly connected to a first end of the second elongated member;

a handle connected to a second end of the second elongated member, the handle connectable to a frame of the railroad car; and a third lever including:

a third elongated member, a plurality of spaced apart first lever connectors connected to the third elongated member, each first lever connector including a top wall, a bottom wall, and a side wall connected to said top and bottom walls, one of the first lever connectors configured to be engaged by the first stop;

a plurality of spaced apart second lever connectors connected to the third elongated member, each second lever connector including a top wall, a bottom wall, and a side wall connected to said top and bottom walls, one of the second lever connectors configured to be engaged by the second stop;

a plurality of first glides bonded to interior surfaces of the first lever connectors and at least one third glide bonded to an exterior first surface of the third elongated member to engage with an exterior surface of the first lever and such that the first lever is slidably received within the first glides bonded to the first lever connectors, and a plurality of second glides bonded to interior surfaces of the second lever connectors and at least one fourth glide bonded to an exterior second surface of the third elongated member opposite the exterior first surface to engage with an exterior surface of the second lever and such that the second lever is slidably received within the second glides bonded to the second lever connectors, at least one third glide bonded to an exterior first side surface of the third elongated member to engage the first elongated member, at least one fourth glide bonded to an exterior second side surface of the third elongated member to engage with the second elongated member, wherein the first lever is slidable relative to the third lever, and wherein the second lever is slidable relative to the third lever.

22. The uncoupling lever assembly of claim 21, wherein the at least one third glide is one of a plurality of spaced apart third glides bonded to the exterior first side surface of the third elongated member to engage the first elongated member, and wherein the at least one fourth glide is one of a plurality of spaced apart fourth glides bonded to the exterior second side surface of the third elongated member to engage with the second elongated member.

23. The uncoupling lever assembly of claim 21, wherein the first stop includes a first lip that extends above the first elongated member, a second lip that extends below the first elongated member, and a third lip that extends transversely beyond the first elongated member.

24. The uncoupling lever assembly of claim 23, wherein the second stop includes a first lip that extends above the second elongated member, a second lip that extends below the second elongated member, and a third lip that extends transversely beyond the second elongated member.

25. The uncoupling lever assembly of claim 21, wherein the first elongated member is tubular, the second elongated member is tubular, and the third elongated member is tubular.

26. The uncoupling lever assembly of claim 21, wherein the glides are polyurethane.

27. The uncoupling lever assembly of claim 21, wherein the hook is pivotally connected to a first end of the first elongated member.

* * * * *